US005550319A

United States Patent [19]

Segan et al.

[11] Patent Number: 5,550,319

[45] Date of Patent: Aug. 27, 1996

[54] DECORATIVE DISPLAY AND ORNAMENT THEREFOR

[75] Inventors: Marc H. Segan, New York, N.Y.; Michael Newsome, Jersey City, N.J.

[73] Assignee: M. H. Segan Limited Partnership, Great Barrington, Mass.

[21] Appl. No.: 771,346

[22] Filed: Oct. 4, 1991

[51] Int. Cl.[6] ..... G10F 1/08

[52] U.S. Cl. ..... 84/103; 84/404; 84/407; 116/155; 116/167

[58] Field of Search ..... 84/102, 103, 404, 84/405, 407; 428/7, 11; 116/155, 157, 167

[56] References Cited

U.S. PATENT DOCUMENTS

| | | | |
|---|---|---|---|
| 1,777,712 | 11/1929 | Barnum | 84/404 |
| 1,816,647 | 4/1930 | Goriup | 84/404 |
| 2,515,439 | 7/1950 | Bronson | 428/11 |
| 3,077,138 | 7/1960 | Vaughn et al. | 84/103 |
| 3,671,958 | 6/1972 | Storz | 116/167 |
| 3,820,265 | 6/1974 | Leonard | 428/11 |
| 3,974,731 | 8/1976 | Joslyn | 84/404 |
| 4,682,079 | 7/1987 | Sanders et al. | 428/11 |
| 4,923,721 | 5/1990 | Gilmore | 428/11 |
| 4,989,120 | 1/1991 | Davis et al. | 428/11 |

*Primary Examiner*—Cassandra C. Spyrou
*Attorney, Agent, or Firm*—Cohen, Pontani, Lieberman, Pavane

[57] ABSTRACT

A display, such as a Christmas display, comprises a plurality of ornaments (14), each including a striker (18), a pair of bells (26, 27) disposed in spaced relation from the striker (18) and a means (46) responsive to an electrical signal from a control unit (12) for moving the striker into contact with one or the other of the bells (26, 27), at least some of the bells on the ornaments having different frequencies such that sequentially striking the bells (26, 27) plays a tune, such as a Christmas carol. The ornaments are preferably distributed about a Christmas tree, though alternatively they may be placed on a flat surface.

17 Claims, 6 Drawing Sheets

FIG. 2
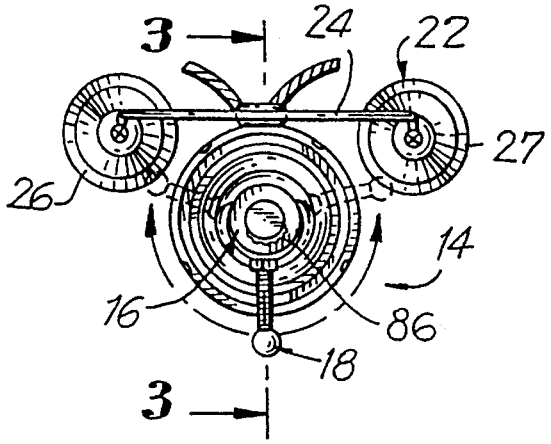
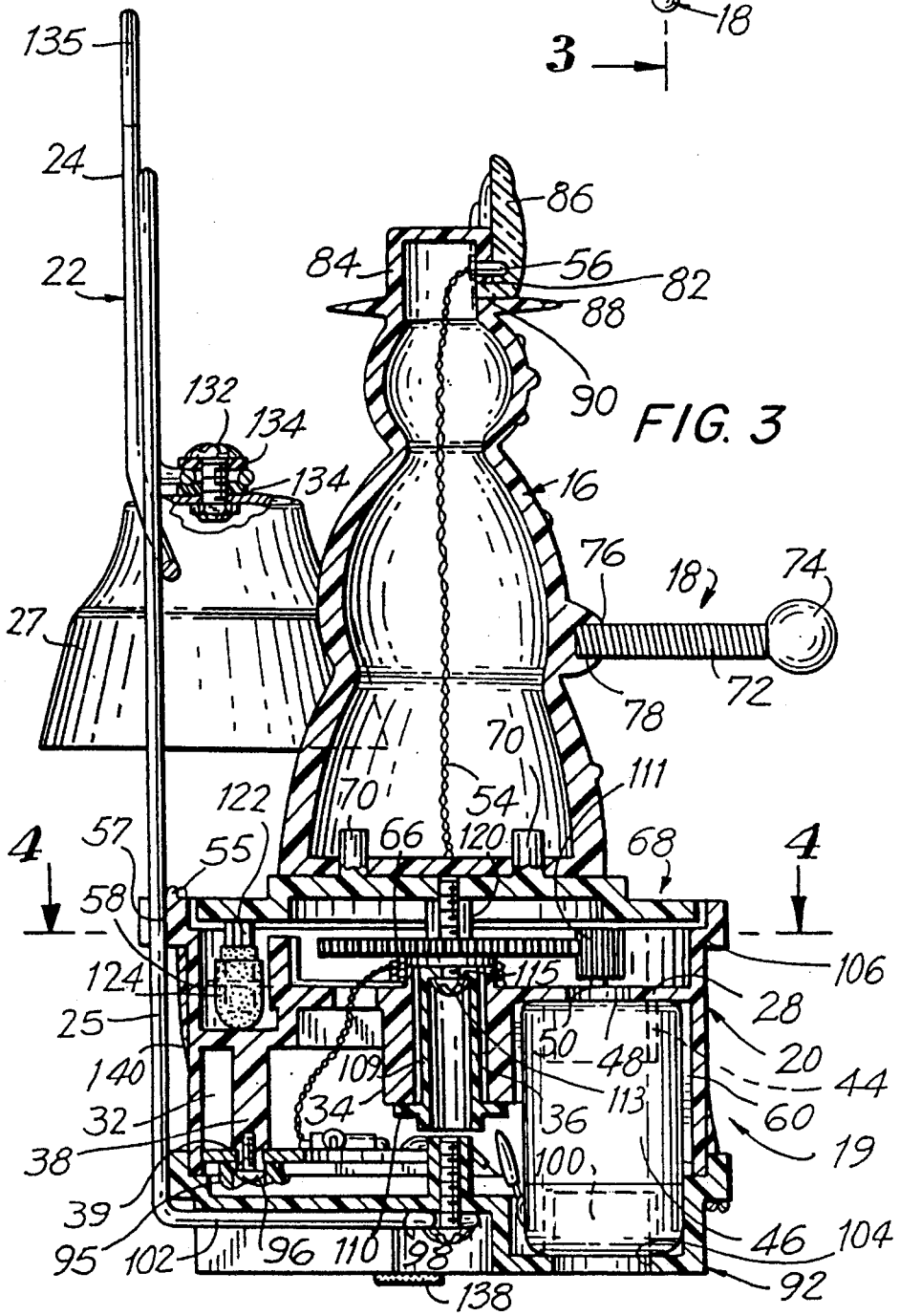
FIG. 3

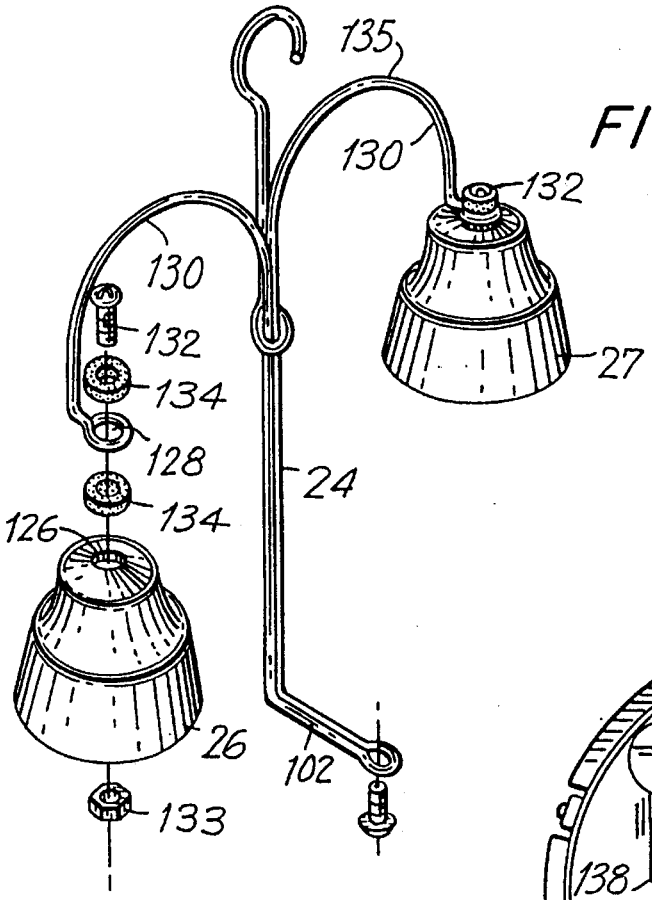
FIG. 3A
FIG. 5A
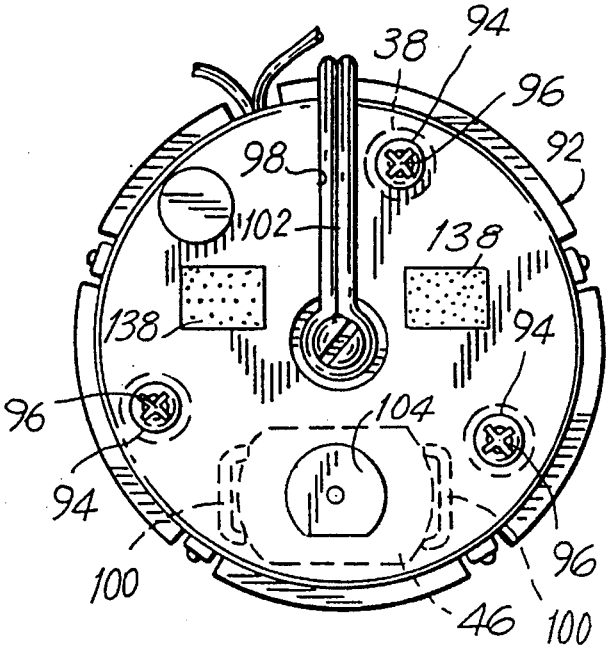
FIG. 6
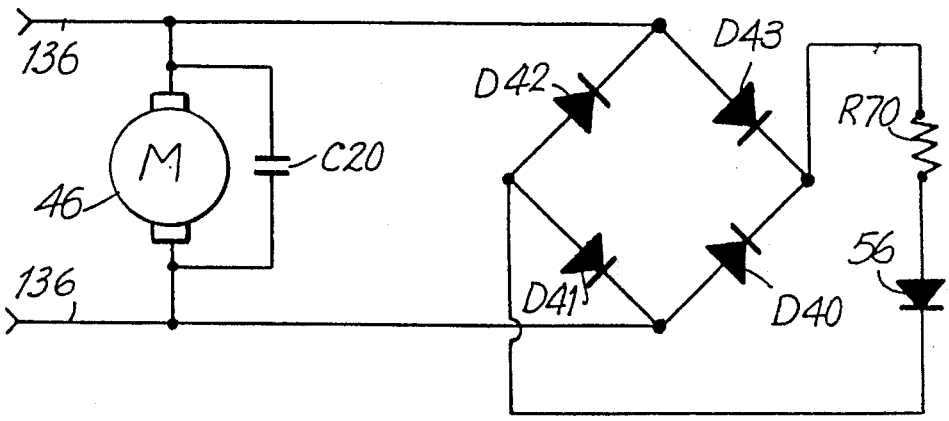

DECORATIVE DISPLAY AND ORNAMENT THEREFOR

BACKGROUND OF THE INVENTION

1. Field of the Invention

This invention pertains to decorative displays, and more specifically to electronic decorative displays incorporating ornaments for generating music and/or a light effect. Most particularly, the present invention pertains to decorative displays of the aforementioned type particularly suited for use as a Christmas display.

2. Prior Art

A wide variety of Christmas ornaments exist. While some such ornaments incorporate music and/or light effects, a substantial market is perceived for a Christmas ornament wherein mechanical movement produces a musical effect optionally combined with a light effect. It is accordingly an object of the present invention to provide a novel Christmas display incorporating one or more ornaments wherein mechanical movement in the ornament causes a musical effect.

It is a further object of the present invention to provide a Christmas ornament of the aforementioned type wherein the mechanical movement comprises movement of a figurine supporting a striker, and wherein the musical effect results from the striker striking a bell positioned on one side of the figurine.

It is still another object of the invention to provide a Christmas ornament of the aforementioned type wherein the striker strikes one of two bells on either side of the figurine.

It is a further object of the present invention to provide a Christmas display incorporating a plurality of Christmas ornaments of the aforementioned type, wherein the bells on the ornaments are struck in a predetermined sequence determined by a control unit for producing a musical tune, such as a Christmas carol.

It is yet a further object of the present invention to provide a Christmas display of the aforementioned type which can be either supported on a Christmas tree or disposed on a flat surface.

Yet another object of the present invention is to provide a Christmas display of the aforementioned type wherein each ornament incorporates a light which is lighted with each mechanical movement of its figurine.

SUMMARY OF THE INVENTION

Broadly speaking, the present invention is a display, such as a Christmas display, comprising: a plurality of ornaments, each including a striker, a pair of bells disposed in spaced relation from the striker, and a means responsive to an electrical signal from a control unit for moving the striker from a rest position to one of two second positions, said striker being in contact with one of said two bells in one of said second positions and the other of said bells in the other of said second positions for striking said bells, at least some of the bells on the plurality of ornaments having different frequencies from each other for accommodating playing of a tune by sequentially striking the bells; a control unit including means for sequentially generating electrical signals for transmission to the means for moving the strikers in each of the plurality of ornaments to their second positions for striking their respective bells in a predetermined sequence for playing the tune; and means for transmitting the electrical signals from the control unit to the means for moving the strikers in the plurality of ornaments.

In accordance with another aspect, the present invention comprises an ornament for inclusion in a display comprising a striker, a pair of bells disposed in spaced relation from the striker, and a means responsive to an electrical signal from a control unit for moving the striker from a rest position to one of two second positions, the striker being in contact with one of the two bells in one of the second positions and the other of the bells in the other of the second positions for striking said bells.

Yet another aspect of the present invention comprises a display comprising a plurality of ornaments, each including a striker supported on a visible, decorative portion of the ornament, a bell disposed in spaced relation from the striker, and a means responsive to an electrical signal for moving the decorative portion of the ornament and the striker supported thereby for moving the striker from a rest position to a second position in contact with the bell for striking same, at least some of the bells on the plurality of ornaments having different frequencies from each other for accommodating playing of a tune by sequentially striking the bells; a control unit including means for sequentially generating electrical signals for transmission to the means for moving the decorative portions in each of the plurality of ornaments to the second positions for moving the strikers for striking their respective bells in a predetermined sequence for playing the tune, whereby each time a bell is struck it is accompanied by a pleasing visual effect comprising movement of the decorative portion of the respective ornament; and means for transmitting the electrical signals from the control unit to the means for moving the decorative portions in the plurality of ornaments.

Yet another aspect of the present invention comprises an ornament for inclusion in a display, the ornament comprising a striker supported on a visible, decorative portion of the ornament, a bell disposed in spaced relation from the striker, and a means responsive to an electrical signal for moving the decorative portion and the striker supported thereby for moving the striker from a rest position to a second position in contract with the bell for striking same, whereby striking of the bell is accompanied by a pleasing visual effect comprising movement of the decorative portion.

In a particularly preferred embodiment of the present invention, each of the ornaments incorporates a light which is lighted each time the striker on the ornament is moved for striking one of the bells.

In the preferred embodiment, the ornaments are provided with hooks whereby the ornaments may be hung from a Christmas tree. Alternatively, the ornaments may be placed on a flat surface, such as a fireplace mantel. Where the display is intended as a Christmas display, the tunes preferably comprise Christmas carols.

The foregoing as well as additional details of the present invention will be apparent from the following detailed description and annexed drawings of the presently preferred embodiment thereof.

BRIEF DESCRIPTION OF THE DRAWINGS

In the drawings:

FIG. 2 is a top plan view of one of the ornaments in the display;

FIG. 3 is a sectional view of the ornament of FIG. 2 taken substantially along the line 3—3;

FIG. 3A is a partially exploded perspective view showing the hanger assembly employed in the ornaments of the present invention;

FIG. 5A is a bottom plan view of an ornament is accordance with the present invention;

FIG. 6 is a schematic representation of the circuit in the base of the ornament of FIG. 2;

DETAILED DESCRIPTION OF THE PREFERRED EMBODIMENT

Figure 1:
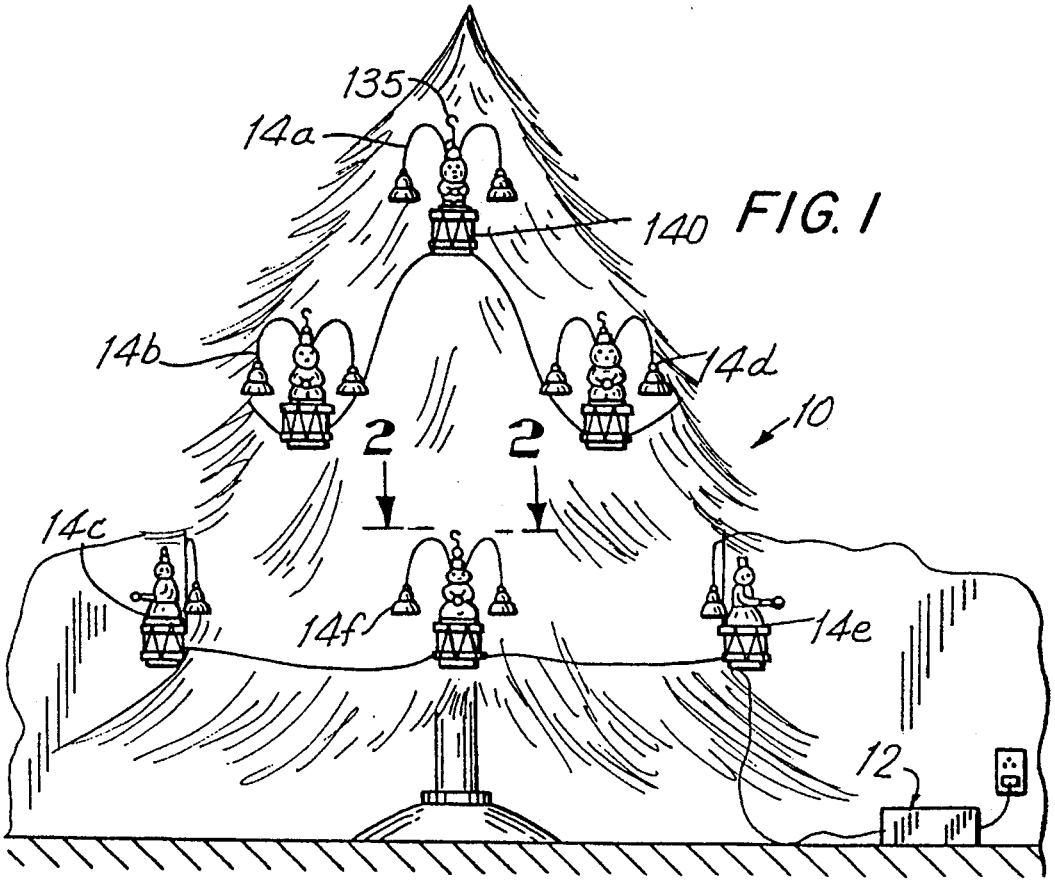
FIG. 1 is a perspective view showing the display of the present invention on a Christmas tree.

Referring now to the drawings, and initially to FIG. 1 thereof, the Christmas display in accordance with the present invention is generally designated at 10. As shown, the Christmas display 10 includes a control unit 12 and a plurality of ornaments 14. In the preferred embodiment shown in the drawings, eight ornaments 14 are employed, six of which are visible in FIG. 1. As best seen in FIGS. 2–5, each ornament includes a figurine 16 supporting a striker 18, a base 19 and a bell assembly 22 comprising a hanger 24 supporting a pair of bells 26, 27 on either side of the figurine 16, such that the bells 26, 27 may be struck by the striker 18 when the figurine 16 is rotated.

Figure 4:
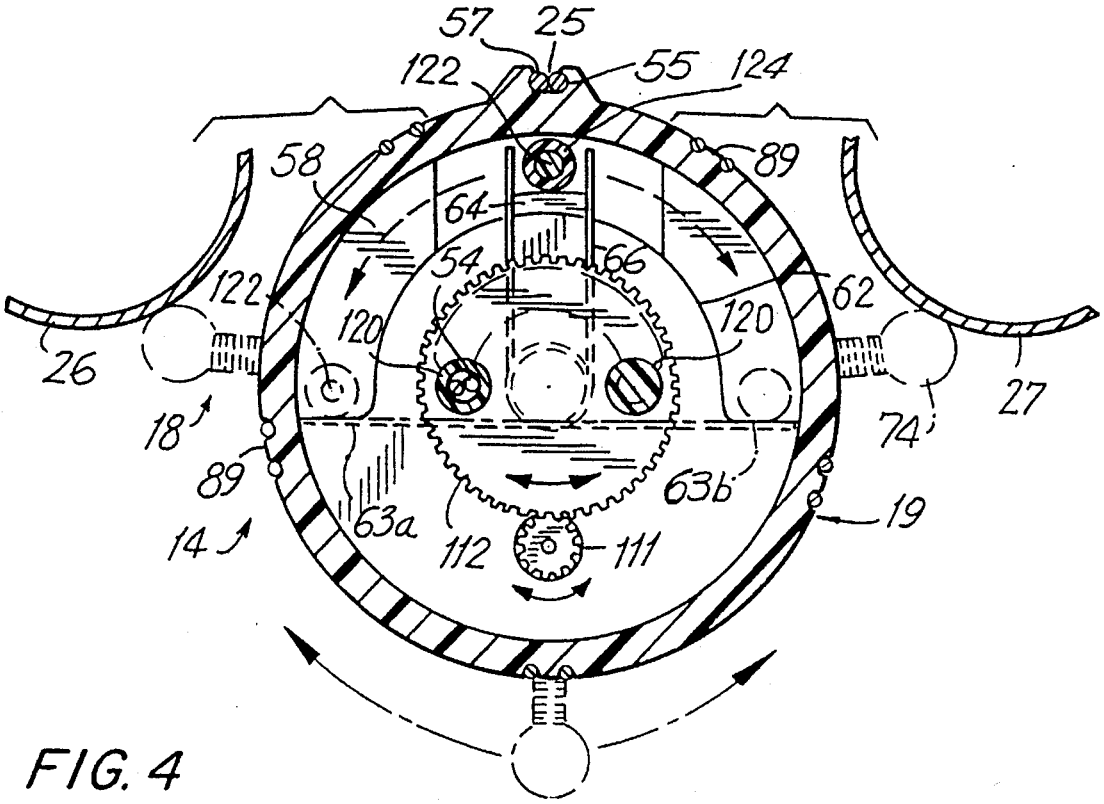
FIG. 4 is another sectional view of the ornament of FIG. 2 taken substantially along the line 4—4 in FIG. 3.
Figure 5:
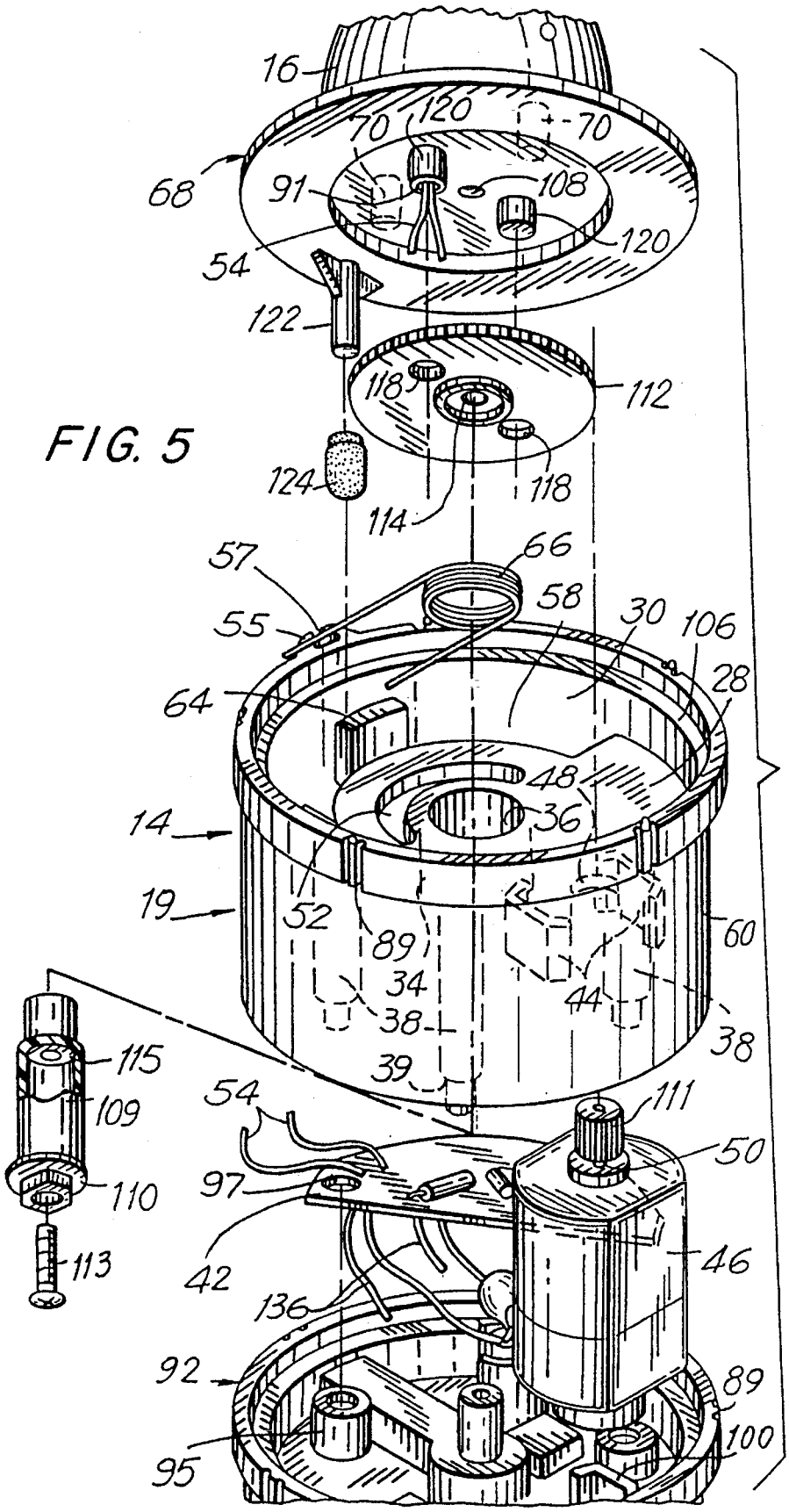
FIG. 5 is an exploded perspective view showing the mechanism inside the base of the ornament of FIG. 2.

Referring to FIGS. 3–5, the base 19, which has the appearance of a toy drum, includes a cylindrical casing 20 having an outer wall 60, a top 68 which serves as a platform for the figurine 16 and is rotatable relative to casing 20, and a bottom 92. Casing 20 and bottom 92 are preferably integrally molded from plastic, such as ABS, where top 68 is preferably integrally molded from polycarbonate. The casing 20 is separated into upper and lower sections 30 and 32, respectively, by a stepped partition 28. Depending from the partition 28 into lower section 32 is a central boss 34 having a bore 36, three screwposts 38 formed with shoulders 39, and a pair of confronting walls 44 defining a chamber for receiving the top of a motor 46. As shown, a through hole 48 is provided in partition 28 between the walls 44 for accommodating the motor shaft 50. An arcuate slot 52 in the partition 28 adjacent the central boss 34 accommodates wires 54 which connect a circuit board 42 in lower section 32 to an LED 56 in the head of the figurine 16. The top of outer wall 60 of casing 20 is formed with a protrusion 55 defining an opening 57 dimensioned for a snap fit with the leg 25 of hanger 24 for retaining the hanger in the proper vertical orientation.

Directing attention to the upper section 30 of the casing 20, stepped partition 28 includes a vertical wall 62 defining an arcuate recess 58 adjacent the outer wall 60. As shown, a post 64 extending from partition 28 into upper section 30 biases the ends of a return spring 66, as will be more fully explained below.

As best seen in FIGS. 3 and 5, the figurine 16 is secured to the upper surface of platform 68. More particularly, the platform 68 includes a pair of upstanding posts 70 which extend into holes in the bottom of the figurine 16, with the figurine 16 being secured to the posts and platform 68 as by glue. The figurine 16 is preferably hollow and formed of a soft material, such as polyvinyl chloride (PVC). While the figurine is depicted in the shape of a small man in uniform, any suitable figurine or other ornamentation will suffice, and in the preferred embodiment, at least one of the figurines has the appearance of a Santa Claus. sA shown in FIGS. 1, 3 and 5, the "toy drum" appearance of base 19 is enhanced by a decorative string 140 zig-zagging around the outer wall 60 of casing 20, the string being secured about posts 89 formed in the top of casing 20 and on the bottom 92.

Referring to FIG. 3, the striker 18, which extends from the "hands" of the figurine 16, comprises a coil spring 72 having a plastic ball 74 secured at its free end. As preferred and shown, the other end of spring 72 is secured to the figurine 16 via a tubular plastic member 76 secured in an opening 78 in the figurine 16, the opening 78 being dimensioned for a snap fit with the plastic member 76.

As best seen in FIG. 3, LED 56 is secured in an opening 82 in the hat 84 of the figurine 16. A clear, plastic decoration 86 is fitted over the LED for protecting the LED and enhancing the visual effect thereof when lighted. Preferably, the plastic decoration 86 has a lip 88 which fits in a slot 90 in the hat 84, the decoration being retained in the slot by glue or other suitable fastening means. As shown, the wire pair 54 connecting the circuit board 42 and LED 56 extends through an opening 91 in the platform 68 and through the hollow body of the figurine 16.

The underside of bottom 92 of base 19 has three recessed holes 94 extending through aligned bosses 95 formed on the upper surface thereof. As shown, the bosses 95 align with screwposts 38 depending from partition 28 such that bottom 92 may be secured to casing 20 by screws 96 extending through the holes 94 and into posts 38. As shown, two of the screws 96 also pass through aligned holes 97 in the circuit board 42 such that the board 42 is held in place between the bosses 95 and shoulders 39 in posts 38. The underside of bottom 92 also defines a radial channel 98 in which the arm 102 of hanger 24 is seated for restraining the hanger 24 against angular movement. The upper surface of bottom 92 includes a pair of upstanding confronting walls 100 aligned with the walls 44 depending from partition 28, the walls 100 defining a chamber for the bottom of motor 46. As shown, the bottom 92 has an opening 104 between the walls 100 for receiving the hub at the bottom end of motor 46.

As noted, platform 68 is free to rotate relative to casing 20. More particularly, and as best seen in FIGS. 3 and 5, the platform 68, which has a centered, threaded hole 108, seats on a shoulder 106 formed on casing 20. A plastic bushing 109 seats in the bore 36 of boss 34, the bushing having a radial flange 110 abutting the end of boss 34 for limiting upward movement of bushing 109 in bore 36. A screw 113 extending through bushing 109 and into threaded hole 108 secures platform 68 to casing 20 for movement relative thereto, the head of screw 113 seating on a shoulder 115 formed in the bushing 109.

As seen in FIGS. 3–5, motor 46 has a metal gear 111 on its shaft 50. The gear 111 rotates the platform 68 via a plastic reduction gear 112. As shown, the gear 112 has a centered, axial opening 114 through which bushing 109 extends. Gear 112 also has two off-center openings 118 which seat on posts 120 depending from platform 68 for securing the gear 112 to the platform such that rotation of gear 112 rotates platform 68. As shown, the wire pair 54 extends through a bore in one of the openings 118.

Referring to FIGS. 3 and 5, platform 68 includes a depending stop 122 which moves in arcuate recess 58 as platform 68 is rotated, the extent of rotation of platform 68 being defined by contact between stop 122 and vertical wall 62. The stop 122 is fitted with a rubber cap 124 for noise reduction and shock absorption purposes. The platform 68 and hence the figurine 16 thereon may be rotated in either direction depending upon the direction of rotation of motor shaft 50. In the rest or nominal portion, the stop 122 is positioned midway in the recess 58. Upon rotation of platform 68, the stop 122 eventually strikes either vertical wall portion 63*a* or 63*b*, depending upon the direction of rotation. As will by now be apparent, the striker 18 and bells 26, 27 are positioned such that when the stop 122 strikes the vertical wall portion 63*a* or 63*b*, the striker 18 strikes one or the other of the bells 26, 27 for generating an audible tone determined by the bell frequency.

After striking one of the bells 26, 27 the platform 68 and the figurine 16 thereon are returned to the nominal or rest position by the return spring 66 whereupon the ornament 14 is ready to respond when the motor 46 receives its next signal. More particularly, and as best seen in FIGS. 3–5, the return spring 66 seats about boss 34 between gear 112 and partition 28. The return spring is a coil spring whose free ends extend radially outward such that when stop 122 is in its rest position, the ends of spring 66 extend on either side of post 64 and stop 122. It will therefore be apparent that when platform 68 is rotated by motor 46, stop 122 moves one arm of spring 66 away from post 64 (dotted line position in FIG. 4) while the post blocks the other arm from following. This biases the spring 66 such that when the electrical signal to motor 46 terminates, the spring returns the stop 122 to its rest position, thereby rotating the figurine 16 to its nominal position midway between the bells 26, 27. As should now be understood, the bias of the spring arms on the stop 122 must be sufficient to return the stop 122 to its nominal position but not so large as to prevent rotation of platform 68 in response to rotation of motor 46. It will be apparent that as the platform 68 rotates, the wires 54 traverse arcuate slot 52 to prevent wire strain. As should now be understood, the bias of the spring arms on the stop 122 must be sufficient to return the stop 122 to its nominal position but not so large as to prevent rotation of platform 68 in response to rotation of motor 46.

The circuit board 42 in each ornament 14 supports the circuit shown in FIG. 6. As shown, the control unit 12 provides the electrical signal for driving motor 46 and lighting LED 56 via wires 136 connected to circuit board 42, the wires 136 extending into the ornament 14 through an opening 142 in the lip of the bottom wall 92. As will be more fully explained below, when one of the bells 26, 27 is to be struck by striker 18, the control unit 12 provides a positive or negative voltage across the motor 46, depending upon which bell is to be struck. A capacitor C20 across the motor leads filters noise that might otherwise be transmitted back to the control unit via wires 136. Since the LED 56 requires a positive voltage, the voltage signal applied to the motor 46 is rectified by the diodes D40, D41, D42 and D43, with the rectified output applied to the wire pair 54 via a current limiting resistor R70. Consequently, each time a bell is struck, the LED lights regardless of motor direction.

As best shown in FIG. 3, the tops of bells 26, 27 have axial holes 126 aligned with corresponding holes 128 formed at the ends of the arms 130 of the hanger 24, the bells being secured to the hanger 24 by screws 132 extending through the aligned holes 126, 128 into nuts 133. As preferred and shown, the free ends of the arms 130 defining the holes 128 seat between rubber grommets 134 disposed about the shafts of screws 132. The hook 135 at the top of hanger 24 accommodate support of the ornament 14 on a branch of a Christmas tree in the manner shown in FIG. 1. Alternatively, the ornaments 14 may be placed on a flat surface. For this purpose, the bottom 92 of each ornament 14 is provided with rubber feet 138 to prevent the ornament 14 from "walking" as the platform 68 is rotated.

Figure 7:
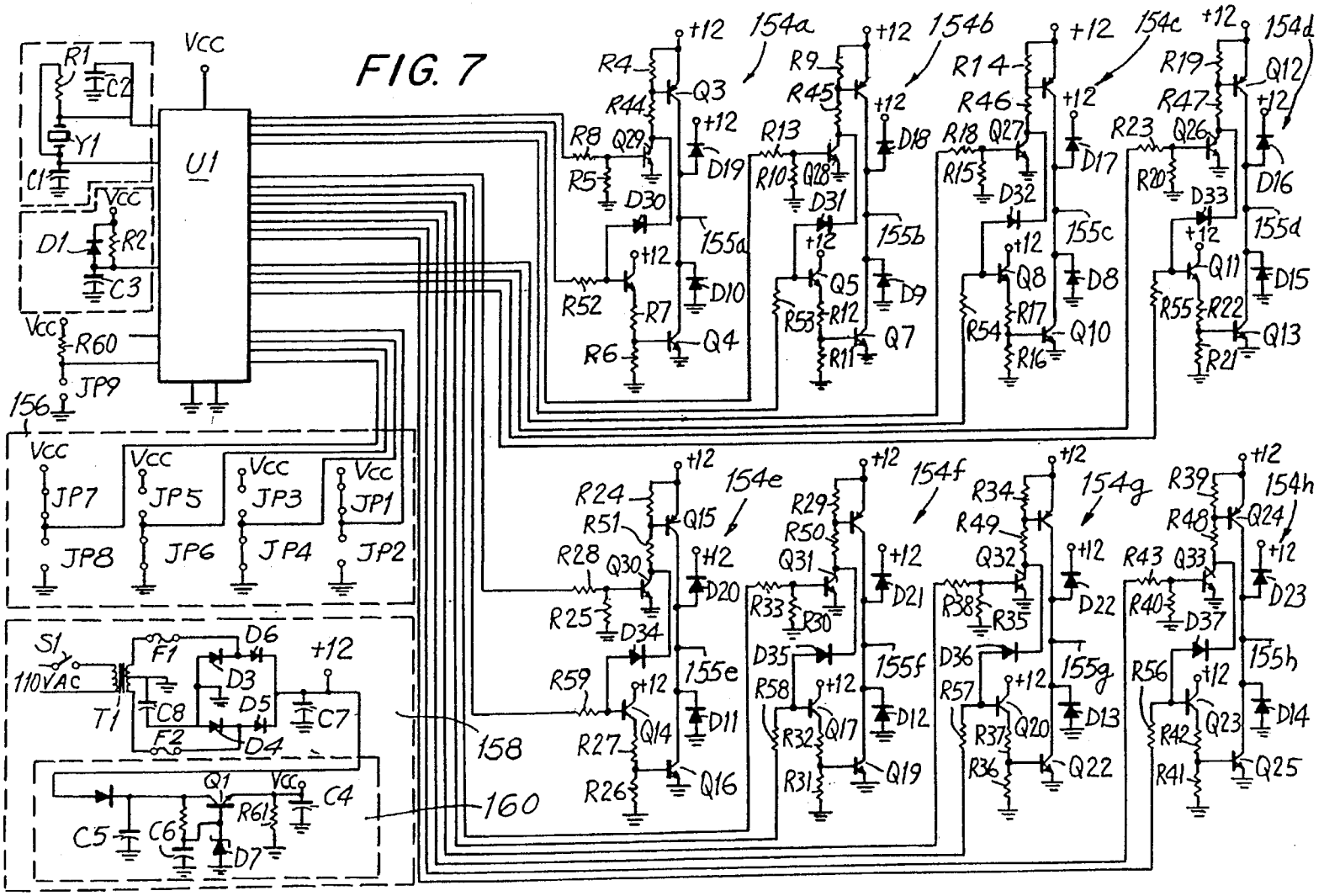
FIG. 7 is a schematic representation of the circuit in the control unit of the display.
Figure 8:
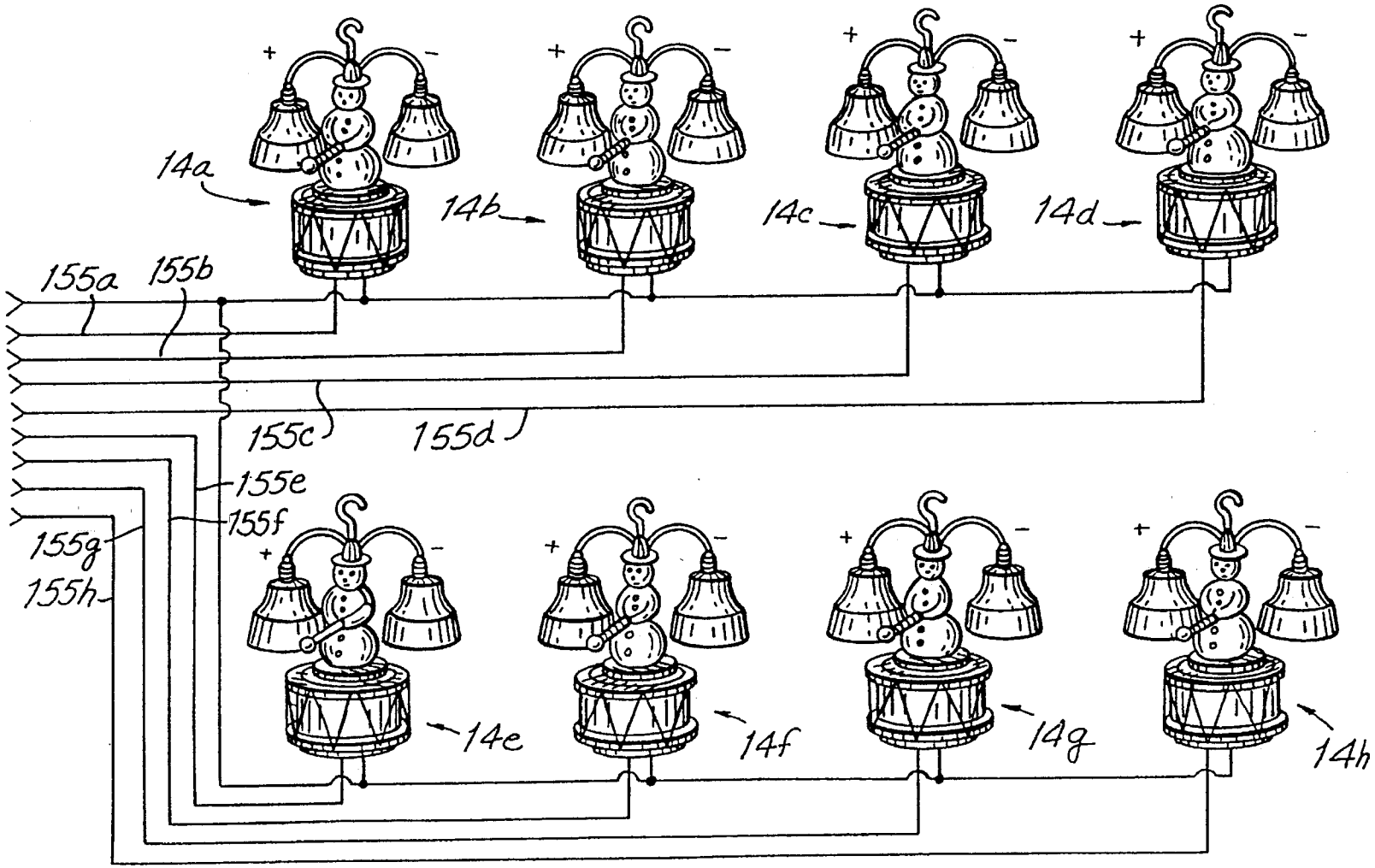
FIG. 8 is a diagrammatic representation of a wiring diagram showing the manner in which the control unit is connected to the ornaments.

Referring now to FIGS. 7–8, the circuitry in the control unit 12 will be more fully described. The heart of the circuit is a microprocessor U1, which may be a Texas Instruments' TMS 7000. Microprocessor U1 has the usual clock circuit, generally designated at 150 in FIG. 7, and a reset circuit, generally designated at 152, which resets the control unit to its initial state when power to U1 is turned on. As explained below, the microprocessor U1 is preprogrammed to "play" a plurality of Christmas songs. In accordance with the invention, each Christmas song is limited to sixteen different notes, i.e., sixteen different frequencies. Each of these sixteen different frequencies may be played by striking one of the two bells on each of the eight ornaments, i.e., each bell has a different frequency. It will therefore be apparent that arrangements may be created to play any Christmas song by striking the bells in the proper sequence.

As noted above, each ornament 14 incorporates its own motor 46. As shown in FIG. 7, each motor 46 has a separate drive circuit 154 inside control unit 12 for driving the motor to the right or left depending upon which of the ornament's bells is to be struck by striker 18. As each of the motor drive circuits 154 is identical, only the motor drive circuit 154*a* for the motor 46 in ornament 14*a* will be described.

As shown, outputs from pins 13 and 14 on U1 are applied to motor drive circuit 154*a* . Each of the outputs from microprocessor U1 to the eight motor drive circuits outputs either a logic 1 set at Vcc=5.5 V or a logic 0 set at 0.0 V. As will be explained below, the motor 46 for ornament 14*a* is driven in one direction if the output from pin 13 is high and the output from pin 14 is low, and in the opposite direction if the output from pin 14 is high while the output from pin 13 is low. If the outputs from both pins are low, the motor connection is open-circuited, i.e., it is free to rotate in response to external forces so the return spring 66 can center the mechanism to its "idle" position.

As will be apparent from FIG. 7, whenever the output from pin 13 goes high, Q29, configured as a current amplifier with a gain of about 100, turns on, establishing the necessary voltage at the base of power transistor Q3 to turn Q3 on. As a consequence, the motor lead 155*a*, which is connected to the collector of Q3, is set at 12 volts. Since, as explained below, the other, common lead to motor 46 is at 6 volts, motor 46 effectively "sees" +6.0 V (12 V–6 V), which drives the motor to the left which, via gear 112, drives platform 68 and figurine 16 thereon to the right whereupon the striker 18 strikes the bell 27 for generating a particular note. When the output from pin 13 goes low, motor lead 155*a* sees an open circuit condition, whereupon return spring 66 acting on stop 122 returns the platform 68 to its neutral position wherein the striker 18 is midway between the bells 26 and 27.

If, subsequently, the song requires that bell 26 be struck, U1 generates a logic 1 output at pin 14 while the output at pin 13 remains low. This turns on transistor Q2 which, like Q29, serves as a current amplifier, which in turn provides the necessary voltage at the base of Q4 to turn Q4 on. As a consequence, the motor lead 155*a* is now connected to the collector of Q4, i.e., motor lead 155*a* is grounded. Since the other motor lead is, as noted above, retained at +6.0 V, effectively −6.0 V is applied across the motor (0.0 V−6.0 V), which rotates the motor 46 to the right for striking the bell 26.

The time duration of motor activation is determined by the pulse width of the signals at the motor drive pins on U1. By appropriately setting the eight jumpers generally designated at 156 in FIG. 7, the pulse width at these pins may be varied between 35 msec. and 250 msec. For use in the present invention, and as preferred and shown in FIG. 7, the jumpers are set for a 109 msec pulse width, which is just sufficient to drive the motors for striking the bells.

The diodes D10 and D19 in motor drive circuit 154*a* serve to limit the amplitude of the voltage spikes generated during operation of motor 46, which spikes could otherwise damage power transistors Q3, Q4. It will be apparent that diode D19 limits the voltage at the collector of Q3 to 12.6 volts. Similarly, diode D10 limits the voltage spikes at the collector of Q4 to 0.6 volts below ground potential.

Diode D30 prevents damage to the power supply and motor drive circuits 154 in the event the outputs at pins 13 and 14 are both high. While U1 is programmed such that this should never happen, if it does, in the absence of D30 the power supply would be grounded through Q3 and Q4, with obvious adverse consequences. Therefore, diode D30 ensures that if the outputs at pins 13 and 14 are both high, only transistors Q29 and Q3 will be turned on. More particularly, when both pins 13 and 14 are high, Q29, and hence Q3, are turned on, thereby grounding the cathode side of D30 through the emitter of Q29. Consequently, the anode side of D30 can never exceed about 0.6 V, which is insufficient to turn on Q2 and Q4, whereby the motor direction is controlled by the output from pin 13, i.e., if inadvertently pins 13 and 14 are both high, the signal from pin 13 dominates.

In FIG. 7, the power supply circuit is generally designated at 158. As shown, in FIG. 1, the control unit 12 plugs into a conventional AC outlet. The power from the AC outlet is applied to the primary of a transformer T1 having a center tapped secondary. The output across the secondary of T1 is applied to a full wave rectifier yielding a 12-volt dc output signal for powering the motor drive circuits 154. The voltage at the center tap of the secondary is approximately +6.0 volts dc, and this +6.0 V dc signal serves as the common lead to motors 46. This is schematically illustrated in FIG. 8, wherein 155*a–h* designate the outputs from the motor drive circuits 154*a–h* for the motors 46 in ornaments 14*a*–h, respectively, and 165 designates the common lead for the motors 46 as derived from the center tapped secondary of T1. As shown, the on/off switch S1 for the control unit 12 is on the primary side of transformer T1.

Power supply circuit 158 also includes a voltage regulator generally designed at 160 which provides an output voltage (Vcc=5.5 v) for powering the microprocessor U1. The bleeder resistor R60 accommodates capacitor discharge to ground to ensure that the microprocessor U1 resets each time switch S1 is closed.

A suitable parts list for the circuits of FIGS. 6–8 is as follows:

| Reference | Part | |
|---|---|---|
| C1 | 68P | Ceramic Disk Cap. |
| C2 | 47P | Ceramic Disk Cap. |
| C3 | 4U7 | 10V Electrolytic Cap. |
| C4,C5 | 100U | 16V Electrolytic Cap. |
| C6 | 20U | 10V Electrolytic Cap. |
| C7,C8 | 6800U | 16V Electrolytic Cap. |
| D1,D30,D31,D32,D33,D34, D35,D36,D37 | 1N4148 | Signal Diode |
| D2,D3,D4,D5,D6,D8,D9,D10, D11,D12,D13,D14,D15,D16, D17,D18,D19,D20,D21,D22, D23 | 1N4001 | Power Diode |
| D7 | 5V6 | +/− 5% Zener Diode |
| F1,F2 | 3A | Fuse |
| JP1,JP2,JP3,JP4,JP5,JP6, JP7,JP8,JP9 | JUMPER | |
| Q1,Q2,Q5,Q8,Q11,Q14,Q17, Q20,Q23,Q26,Q27,Q28,Q29, Q30,Q31,Q32,Q33 | NPN | Gen. Purpose, HFE >100 |
| Q3,Q6,Q9,Q12,Q15,Q18, Q21,Q24 | PNP PWR | Transistor, KSA928AY |
| Q4,Q7,Q10,Q13,Q16,Q19, Q22,Q25 | NPN PWR | Transistor, KSC2328AY |
| R1 | 1M +/− 5% | ¼W Carbon Film Res. |
| R2 | 22K | ¼W Carbon Film Res. |
| R3,R8,R13,R18,R23, R28,R33,R38,R43 | 2K2 | ¼W Carbon Film Res. |
| R4,R5,R6,R9,R10,R11, R14,R15,R16,R19,R20 R21,R24,R25,R26,R29, R30,R31,R34,R35,R36, R39,R40,R41,R60, | 10K | ¼W Carbon Film Res. |
| R7,R12,R17,R22,R27, R32,R37,R42 | 47 | ¼W Carbon Film Res. |
| R44,R45,R46,R47,R48, R49,R50,R51, | 150 | ¼W Carbon Film Res. |
| R52,R53,R54,R55,R56, R57,R58,R59 | 330 | ¼W Carbon Film Res. |
| R61 | 560 | ¼W Carbon Film Res. |

-continued

| Reference | Part | |
|---|---|---|
| S1 | SW SPST | Slide Switch (On/Off) |
| T1 | 12.0 VCT | Power Transformer |
| U1 | 28 PIN | Micro TI TMS70CT40 |
| Y1 | 5 Mhz | Ceramic Resonator |
| C20 | .01 U | Ceramic Disk Cap. |
| D40,D41,D42,D43 | 1N4148 | Signal Diode |

As the manner in which the display 10 functions should by now be apparent, brief overview will suffice. Microprocessor U1 is programmed to play a plurality of songs, typically Christmas carols, such as "Jingle Bells", "Silent Night", etc., by sequentially outputting the appropriate motor drive signals at its output pins for striking the bells 26, 27 on the ornaments 14 in the proper sequence for playing the songs. As the manner of programming the microprocessor U1 to output the proper sequence of signals at its output pins for playing the desired songs will be apparent to those of ordinary skill in the art once this description is known, a further description thereof is unnecessary. In the preferred embodiment shown in the drawings, the sixteen bells on the eight ornaments 14 play the following notes:

| ORNAMENT | BELL NUMBER | NOTE |
|---|---|---|
| 14a | 1 | A |
| | 2 | D |
| 14b | 3 | E |
| | 4 | G flat |
| 14c | 5 | G |
| | 6 | A flat |
| 14d | 7 | A |
| | 8 | B |
| 14e | 9 | D flat |
| | 10 | D |
| 14f | 11 | E flat |
| | 12 | E |
| 14g | 13 | G flat |
| | 14 | G |
| 14h | 15 | A flat |
| | 16 | A |

In the above listing, the lowest frequency note is listed first, with each succeeding note representing a higher frequency, which will be in the next octave if necessary, e.g. the A note of bell number 7 in ornament 14*d* is one octave above the A note in bell number 1 of ornament 14*a*. Of course, other notes may be substituted for those listed above. It should be noted, however, that bell selection requires some care, as only sixteen different notes may be sounded, only two bells may be struck simultaneously and it is not possible to simultaneously strike the two bells on a single ornament. The bell selection listed above was carefully selected with these limitations in mind. Therefore, even with this selection, it was necessary to compose specific musical arrangements meeting the aforementioned limitations.

As noted previously, each motor drive circuit 154*a–h* for the ornaments 14*a–h* receives signals from two output pins in microprocessor U1 for driving the corresponding motor 46 to the right or left depending upon which of the bells 26, 27 is to be struck. Because of overall power supply limitations in the circuits shown in FIG. 7, only two motor drive circuits 15Y may be energized at any given time, whereby only two bells may be struck simultaneously. However, because the bells resonate after being struck, a chord effect can be obtained by striking a plurality of bells in rapid succession. Alternatively, by modifying the circuit of FIG. 7 in a manner that will be apparent to those of ordinary skill in the art once this description is known, three or more bells may be struck simultaneously.

In any event, an important aspect of the preferred embodiment of the present invention is the combined musical and visual effect created as the figurines 16 rotate to strike their respective bells. Indeed, because each figurine 16 can rotate in two directions, persons observing the display 10 experience a certain anticipation as they wonder which ornaments will be struck next and in what direction the figurines will rotate. It has been found that this adds significantly to the overall impact of the display 10 on the viewer.

As shown in FIG. 1, it is contemplated that the ornaments 14 will be distributed about a Christmas tree, with the control unit 12 placed on the floor beneath the tree, preferably out of sight. Each of the ornaments 14 may be hung by the hook 135 at the top of its respective hanger 24. Alternatively, and as noted above, the ornaments 14 may be placed on a flat surface, such as a fireplace mantel.

Each time the display 10 is turned on by closing switch S1 on control unit 12, the microprocessor U1 resets and outputs signals for playing the first song in its memory, followed by the second, third, etc., with the cycle being repeated if the display 10 is left on for a sufficient period of time.

While the foregoing constitutes a description of a preferred embodiment of the present invention and some possible modifications thereto, yet additional changes and modifications may be made therein without departing from the spirit and scope of the invention. For example, while eight ornaments 14 are preferred and shown, more or less than eight may be employed. Also, though each ornament 14 preferably has two bells 26, each of which may be struck by the striker 18 depending upon the direction of rotation thereof, one or more ornaments could, instead, be provided with a single bell. Of course, reducing the number of bells without increasing the number of ornaments limits the number of available notes.

Also, while bells are presently preferred, other devices which produce an audible frequency when struck may be employed in some or all of the ornaments 14. For example, xylophone bars may be substituted. If desired, one or more ornaments may combine a percussion device, such as a pair of miniature drums, for enhancing the musical effect.

Furthermore, while the circuit shown in FIG. 7 is presently preferred, once this description is known those of ordinary skill in the art will recognize that other circuit configurations may be employed. Likewise, those of ordinary skill in the art will also recognize that alternative mechanisms for rotating the strikers 18 may be employed. And while preferably striker 18 is rotated to strike its respective bells, other types of movement and mechanisms for effecting same will be apparent to those of ordinary skill in the art once this description is known. Indeed, by employing an alternative mechanism and movement, an ornament may be constructed with three or more bells, each of which may be struck by appropriate movement of the ornament's striker.

Since these as well as additional changes and modifications are intended to be within the scope of the present invention, the foregoing description should be construed as illustrative, and not in a limiting sense, the scope of the invention being defined by the following claims.

We claim:

1. An ornament for inclusion in a display comprising:

a striker movable in first and second directions, first and second tone generating means for generating corresponding first and second tones when struck, said first tone being different from said second tone, said striker being disposed between said first and second tone generating means, and moving means responsive to an electrical signal for moving said striker from a rest position to strike either of said first and second tone generating means, said striker striking said first tone generating means when moved in said first direction and said striker striking said second tone generating means when moved in said second direction, and said striker coming to rest in said rest position after striking one of said first and second tone generating means.

2. The ornament of claim 1, wherein said striker rotates relative to said first and second tone generating means, and wherein said moving means for moving said striker comprises rotating means for rotating said striker.

3. The ornament of claim 2, wherein said rotating means for rotating said striker comprises a motor.

4. The ornament of claim 3, wherein said ornament includes a base having a casing defining a chamber and a platform rotatable relative to said casing, wherein said striker is secured to said platform for rotation therewith, and wherein said motor is disposed in said chamber and has a shaft connected to said platform for rotating same in response to said electrical signal for rotating said striker from said rest position to one of said first and second directions in contact with the respective first and second tone generating means dependent upon the direction of rotation of said motor.

5. The ornament of claim 4, further comprising returning means for returning said striker to said rest position after striking said respective tone generating means.

6. The ornament of claim 5, wherein said casing for said ornament includes a wall in said chamber, wherein said platform includes a stop movable therewith relative to said wall, wherein said stop is in a first position in spaced relation from said wall when said striker is in said rest position and wherein first and second positions of said striker are defined by contact between said stop and said wall.

7. The ornament of claim 6, wherein said striker comprises a flexible, resilient shaft having a contacting member at one end thereof, and wherein said striker striking in said first and second directions is in close spaced relation from said respective first and second tone generating means whereupon inertia moves said contacting member into contact with said respective tone generating means, such movement being accommodated by said flexible, resilient shaft of said striker.

8. The ornament of claim 7, wherein said returning means for returning said striker to its rest position comprises a return spring having a portion abutting said stop for movement therewith upon rotation of said platform, movement of said portion of said return spring biasing same for returning said stop to said first position upon termination of said electrical signal to said motor.

9. The ornament of claim 4, further comprising a figurine secured to said platform for rotation therewith, and wherein said striker is secured to said figurine.

10. The ornament of claim 9, further comprising a light secured to said figurine and wherein said light is responsive to said electrical signal whereby said light is lighted each time said motor is activated.

11. The ornament of claim 1, further comprising a light responsive to said electrical signal whereby said light is lighted each time said striker is moved.

12. The ornament of claim 1, wherein said ornament includes a hanger having two arms, wherein one of said two tone generating means is secured to each of said two arms, and wherein said hanger includes means for securing said ornament to a Christmas tree.

13. The ornament of claim 12, further comprising means for supporting said ornament on a flat surface.

14. The ornament of claim 1, wherein said striker is supported on a decorative portion of said ornament whereby the striking of at least one of said first and second tone generating means is accompanied by a pleasing visual effect comprising movement of said decorative portion.

15. The display of claim 1, wherein each of said first and second tone generating means comprises a bell.

16. The display of claim 1, wherein said ornament has a percussion member, and wherein said moving means for moving said striker comprises means for moving said striker on said ornament into contact with said percussion member.

17. A display comprising:

a plurality of ornaments, each including a striker, first and second tone generating means for respectively generating first and second tones when struck, said striker being disposed between said first and second tone generating means, and moving means responsive to an electrical signal for moving said striker from a first, rest position to either of two second positions for striking said first tone generating means in one of said second positions and said second tone generating means in the other of said second positions, said striker coming to rest in said rest position after striking one of said first and second tone generating means, at least some of said first tone generating means on said plurality of ornaments having different frequencies from said respective second tone generating means for accommodating playing of a tune by sequentially striking said first and second tone generating means;

a control unit including means for sequentially generating electrical signals for transmission to said moving means for moving said striker in each of said plurality of ornaments to said second positions for striking said respective first and second tone generating means in a predetermined sequence for playing said tune; and transmitting means for transmitting said electrical signals from said control unit to said moving means for moving said striker in each of said plurality of ornaments.

* * * * *